United States Patent [19]

McCauley et al.

[11] 3,975,920

[45] Aug. 24, 1976

[54] AIR CONDITIONER DAMPER CONTROL

[75] Inventors: Michael J. McCauley; Richard L. Shaner, both of Louisville, Ky.

[73] Assignee: General Electric Company, Louisville, Ky.

[22] Filed: Oct. 6, 1975

[21] Appl. No.: 619,695

[52] U.S. Cl. ..... 62/262; 62/409; 98/94 AC

[51] Int. Cl.[2] ..... F25D 23/12

[58] Field of Search ..... 62/262, 267, 410, 409; 98/94 AC

[56] References Cited

UNITED STATES PATENTS

| | | | |
|---|---|---|---|
| 2,391,859 | 1/1946 | Babcock | 62/409 |
| 2,408,972 | 10/1946 | Eberhart | 62/262 |
| 2,720,090 | 10/1955 | Ford | 62/262 |
| 2,801,582 | 8/1957 | Kuhlenschmidt et al. | 98/94 AC |
| 2,950,667 | 8/1960 | Rose et al. | 98/94 AC |
| 2,986,016 | 5/1961 | Gillham et al. | 62/409 |
| 3,152,456 | 10/1964 | Prendergast | 98/94 AC |
| 3,823,574 | 7/1974 | Bolton | 62/262 |

*Primary Examiner*—Lloyd L. King
*Attorney, Agent, or Firm*—Frank P. Giacalone; Francis H. Boos

[57] ABSTRACT

The present invention relates to a room air conditioning unit and is more specifically directed to the airflow control mechanism for adjusting the airflow through a vent generally associated with such units for permitting a flow of air between the air conditioned space and the outdoor air.

4 Claims, 4 Drawing Figures

FIG. 3
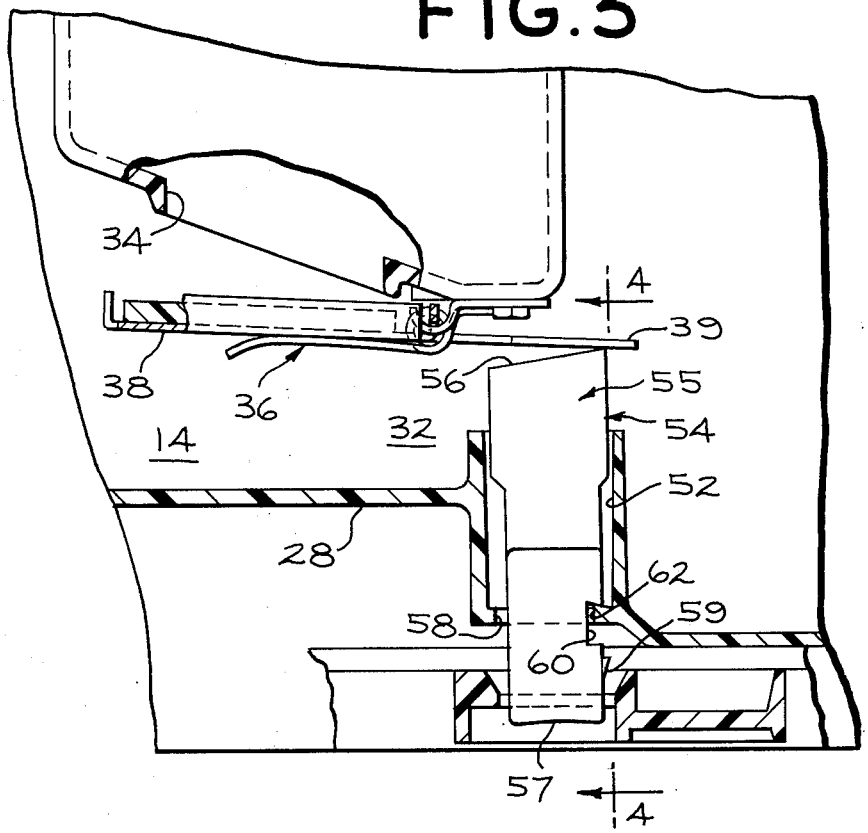
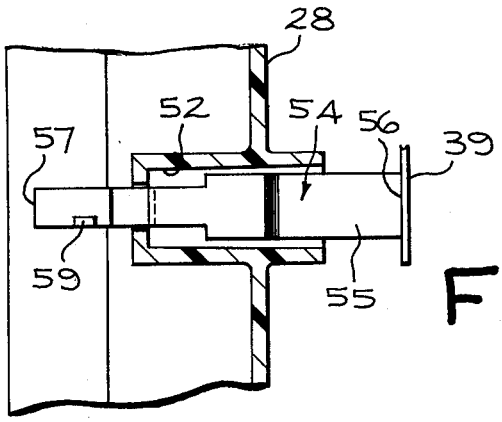
FIG. 4

AIR CONDITIONER DAMPER CONTROL

BACKGROUND OF THE INVENTION

1. Field of the Invention:

According to the present invention, there is provided a room air conditioner having a housing divided by an interior barrier into an indoor, and outdoor, compartments. The evaporator or cooling means of the air conditioner is mounted in the indoor compartment and the condenser unit is mounted in the outdoor compartment. Air moving means are provided in both compartments for circulating air therethrough. In order to obtain flow of air between one compartment and the other, thereby obtaining exhaust or venting of air from or to the room, a vent or aperture is provided in the barrier. To control the airflow through the aperture, a damper is provided which is movable from a fully-closed position to a fully-open position by a slidably arranged pushbutton.

2. Description of the Prior Art:

Some prior art air conditioners provide vents or apertures in the barriers dividing the housing into separate compartments through which fresh air may be introduced from the outside into the room, and through which stale air from the room may be exhausted. In U.S. Pat. No. 2,950,667-Rose, assigned to the General Electric Company, assignee of the present invention, there is shown a multi-position, slidably-arranged member which is connected to a vent door by a control rod. While the arrangement shown in the Rose patent is effective in causing the vent door to open and close, the arrangement is expensive and difficult to properly assemble since the link must be connected at both ends and must be shaped and dimensioned accurately. Other attempts at providing venting for a room air conditioning unit are shown in U.S. Pat. Nos. 2,858,678-Rose, also assigned to the General Electric Company, assignee of the present invention; 2,408,972-Eberhart; 2,720,090-Ford; and 2,801,582-Kuhlenschmidt et al. The Rose patent discloses a complex, multi-link mechanism which is interlocked with the air conditioning control mechanism and is therefore expensive and unduly complicated to assemble conveniently.

The Eberhart and Kuhlenschmidt et al patents show multi-purpose or functional venting systems wherein several patterns of indoor/outdoor airflows are possible by manipulating a single control knob. This system is complex and expensive to manufacture and assemble. The Ford patent shows the use of electromagnetic solenoids to move ventilating and exhaust dampers through a switch which selects various predetermined operating combinations of the units and the venting and exhaust airflow patterns are determined with the air conditioner unit operation.

Accordingly, it is an object of the present invention to provide an improved mechanism for controlling the airflow through an air vent of a room air conditioner which is of extremely simple construction and which may be cheaply manufactured.

It is another object of the invention to provide a damper-controlling means which is easy to operate and lock into a vent-open position by a simple push action.

SUMMARY OF THE INVENTION

The present invention relates to an air conditioner that is divided by a barrier into inner and outer sections, with said barrier having an aperture for permitting the flow of air from one section to the other. Air valving means are hingedly mounted on the barrier so that it is positioned across the aperture. The air valving means is biased in a closed position across the aperture by a spring. An actuating member is slidably arranged so as to have one end extending into the intersection being operably associated with the valving means so as to pivot the valving means to an open position against action of the spring. A latch means is provided to maintain the air valving means in its open position against action of the spring.

BRIEF DESCRIPTION OF THE DRAWINGS

FIG. 3 is an enlarged plan view of the venting system, and

FIG. 4 is a view taken along lines 4—4 of FIG. 3 showing certain details of construction.

DESCRIPTION OF THE PREFERRED EMBODIMENT

Figure 1:
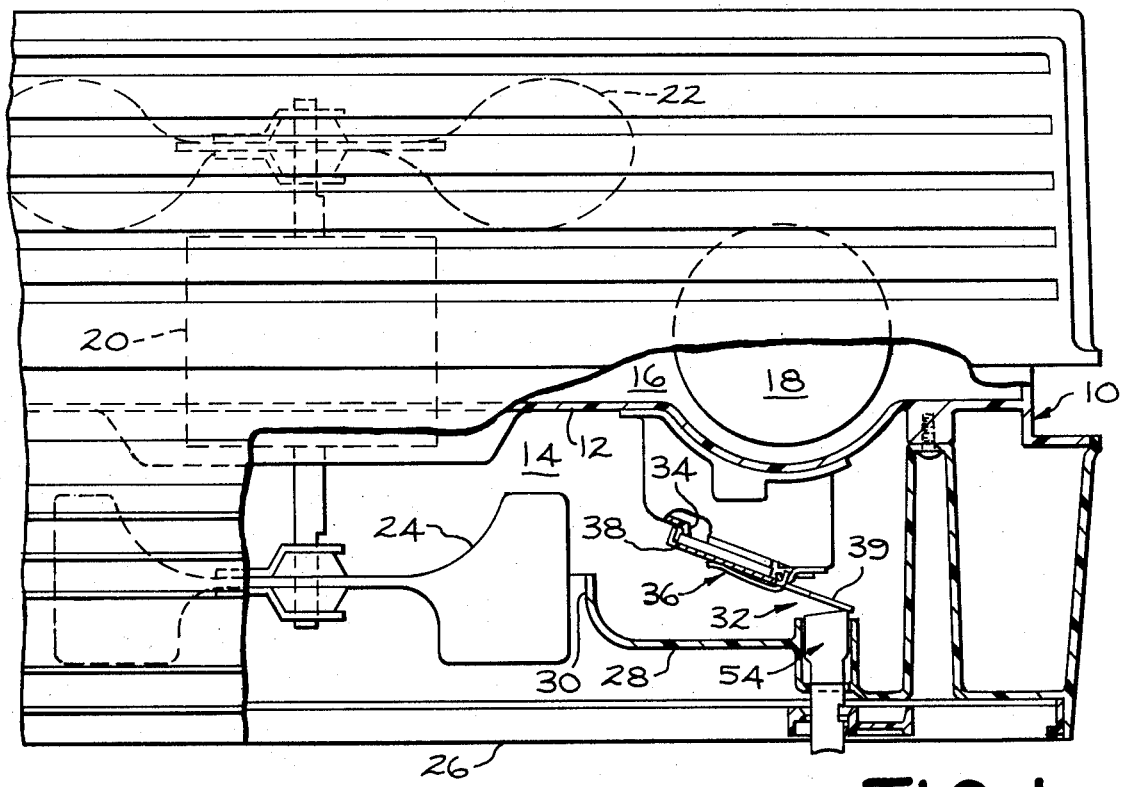
FIG. 1 shows a partial plan view of an air conditioning unit incorporating the present invention with parts broken away.

Referring to FIG. 1, there is shown a self-contained room air conditioner having a housing 10 adapted for mounting in a window or other aperture of a room to be conditioned. The space within the housing is divided by a barrier 12 into an inner section 14 and an outer section 16. The housing 10 is normally positioned within a window such that the inner section 14 is adjacent the room to be conditioned and the outer section 16 projects toward the outside.

Within the outer section 16 of the conditioner, there is positioned a condensing unit (not shown), and a compressor 18, while the inner section 14 contains an evaporator (not shown). A fan motor 20 conveniently mounted on the barrier 12 is of the double shaft variety, with one of said shafts extending into the outer section 16 having a fan 22 mounted thereon for moving air through the outer section 16 and across the condenser, while the other shaft projecting into the inner section 14 carries a fan 24 which moves air through the inner section 14 and across the evaporator. In the air conditioning unit employed with the present embodiment, the inner section 14 is defined by an outer frame means or appearance cabinet 26. The frame 26 includes a wall section or member 28 having an aperture 30 in which the inner fan 24 is arranged.

As thus far described, the air conditioner with its two separate sections 14 and 16 forms no part of the present invention and is intended only to be illustrative of the type air conditioner to which the invention may be adapted, and, as now will be explained, the invention deals with a venting system.

In order to exhaust stale air from within the room to the outside and to bring fresh air from outside to be mixed with the recirculated room air, there is provided an aperture 34 (FIG. 1 and 3) in the barrier 12 which permits the flow of air between the separate sections 14 and 16.

In order to control the flow of air through the aperture 34, there is provided a venting structure 32 including an air valving means 36 and an operating member 54. The air valving means 36 includes a damper portion 38 which is mounted in relation to the aperture 34, such that its movement controls the flow of air therethrough, and an operating portion 39 which, as will be explained hereinafter, acts as a lever to move damper portion 38 between an open and closed position relative to aperture 34.

Figure 2:
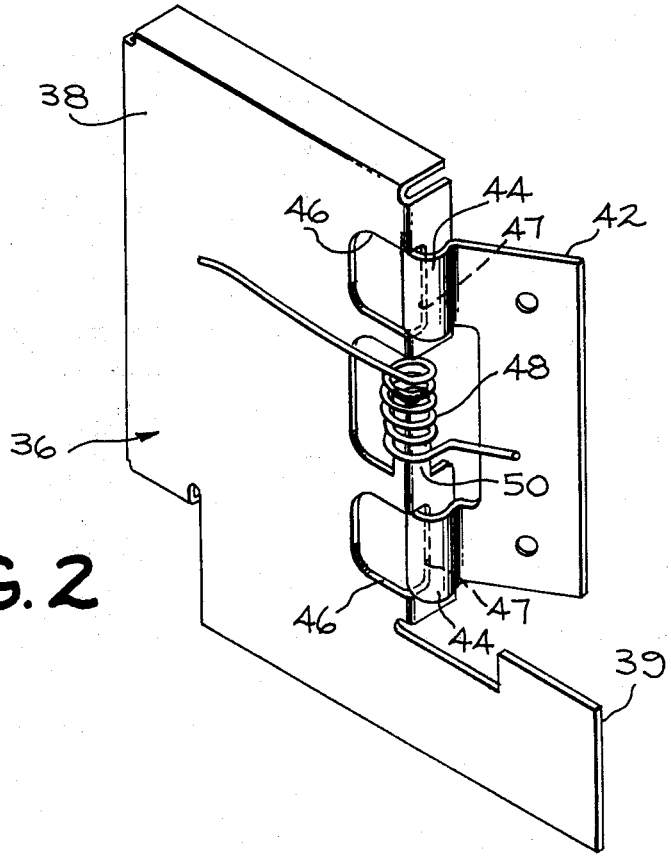
FIG. 2 shows an enlarged schematic view in perspective showing a portion of the venting system.

The air valving means 36 is hingedly supported on a bracket 42 (FIGS. 2 and 3) which is attached to the barrier 12 adjacent the aperture 34 by any suitable means. The bracket 42 has ears or curved projections 44 which are received in cooperating openings 46 and around receiving portions 47 located on the vertically disposed edge of damper portion 38 to provide an effective hinge arrangement for rotating the air valve means 36 relative to barrier 12.

The air valving means 36 and, more specifically, the damper portion 38 is maintained in a closed position over aperture 34 by a biasing spring 48. Spring 48 is of the torsion variety and has its coiled body portion arranged on a support member 50 formed on damper portion 36 and is in substantially axial alignment with projection 44 and portions 47. One free end of the spring 48 bears against stationary bracket 42 with the other end bearing against damper portion 38.

As shown in FIGS. 1 and 3 of the drawings, the air valving means 36 is hinged intermediate the damper 38 and operating portions 39. With the damper 38 biased normally closed as seen in FIG. 1, it is then apparent that movement of the operating portion 39 toward barrier 12 will pivot air valving means 36 and, accordingly, move damper portion 38 to an open position as shown in FIG. 3.

Referring to FIGS. 1 and 3, means are provided by the present invention for manually rotating the air valving means 36 against action of the biasing spring 48 by the user of the air conditioning unit. Accordingly, to this end, the operating member 54 is slidably arranged in a passageway 52 formed in the wall section 28. The passageway 52 is axially aligned with at least a segment of the operating portion 39 so that one end 56 of the operating member 54 arranged in passageway 52 extends into inner section 14 and is adapted to be in cooperating engagement with portion 39. The opposite end 57 of member 54 is dimensioned to extend through an opening 58 so as to be accessible to the user of the air conditioner.

Means are provided to allow limited axial movement of member 54 and to maintain it within the passageway 52. Referring to FIG. 1, it should be noted that the segment 55 of member 54 adjacent end 56 is of greater cross-section than opening 58 to provide stop means in the direction away from section 14 toward opening 58. A projection 59, FIG. 3, is dimensioned to prevent end 57 from entering opening 58 and to limit its axial travel toward section 14.

The member 54 is inserted into the passageway 52 until projection 59 is forced through opening 58 during the assembly and fabrication of the frame 26 prior to its attachment to the housing 10 and accordingly is independent of the housing 10 and air valving means 36, and accordingly there is no direct connection between air valving means 36 and operating member 54. This arrangement lends itself to mass production techniques in that the air valving means 36 is assembled on the barrier 12 and the venting system is automatically completed at the time the frame 26 is assembled to the housing 10.

To rotate the valving means 36 and more specifically to move damper portion 38 to its open position to provide venting in accordance with the present invention, the member 54 is moved axially to the position shown in FIG. 3, wherein, the end 56 engages portion 39 and rotates the valving means 36 against action of spring 48. Action of the spring 48 between the portions 39 and 56 tends to push or maintain member 54 so that end 57 thereof is normally projecting through opening 58 or into the room side of the air conditioner as shown in FIGS. 3 and 4. Accordingly means are provided to maintain the damper 38 in its open position against action of spring 48. Member 54 is therefore provided with a notch portion 60 which is adapted to engage a holding or latch portion 62 formed on the cooperating edge of opening 58. In order to engage the portions 60, 62, it is merely necessary to move member 54 axially until portions 60 and 62 engage as shown in FIG. 3. To prevent the portions 60, 62 from disengaging and damper 38 from accidentally closing, the engaging surfaces of 60, 62 are conveniently tapered so that the forces applied to member 54 by spring 48 through portion 39 tend to move or drive the portions 60, 62 into engagement. To close damper 38, the member 54 is moved laterally to disengage portions 60, 62 thereby allowing spring 48 to rotate air valving means 36 as shown in FIG. 1.

While in accordance with the Patent Statutes, there has been described what, at present, is considered to be the preferred embodiment of the invention, it will be obvious to those skilled in the art that various changes and modifications may be made thereto without departing from the invention, and it is intended, therefore, in the appended claims to cover all such changes and modifications as fall within the true spirit and scope of this invention.

What is claimed is:

1. In an air conditioning unit, including a base structure divided by a barrier into inner and outer sections, frame means removably arranged on said base structure including a front wall being spaced from said barrier defining an inner compartment, and air means arranged in an opening in said front wall for moving air through said compartment comprising:

an aperture in said barrier for permitting the flow of air from one compartment to the other;

air valving means hingedly mounted on said barrier so that it is positioned across said aperture;

resilient means for continually biasing said air valving means in a closed position across said aperture;

a guide member arranged in the front wall of said frame means including a passageway being axially aligned with at least a portion of said damper when said frame means is arranged on said base structure;

an actuating member slidably arranged in said passageway having one end extending into said inner compartment being operably associated with said air valving means for pivoting said air valving means to an open position when said actuating member is moved axially toward said air valving means and for retracting said actuating member relative to said passageway under influence of said resilient means when said air valving means is in its closed position;

latch means on one of said members arranged to engage holding means on the other of said members when said air valving means is in its open position for removably securing said actuating member relative to said passageway to maintain said air valving means in its open position against action of said biasing means.

2. The invention, according to claim 1, wherein said air valving means is arranged in said inner compartment and includes a damper portion and an operating portion, said air valving means being hingedly mounted intermediate said portions on said barrier so that said damper portion is positioned across said aperture and said operating portion being associated with one end of said actuating member.

3. The invention according to claim 2 wherein said passageway includes an opening on one end having a smaller cross section than said passageway, said actuating member including an enlarged portion arranged in said passageway and a smaller portion projecting through said passageway opening.

4. The invention according to claim 3 wherein said notch portion is arranged on said actuating member and said latch portion being formed on said passageway.

* * * * *